US005915659A

United States Patent [19]

Scannell, Jr.

[11] Patent Number: 5,915,659

[45] Date of Patent: Jun. 29, 1999

[54] ADJUSTABLE KEYBOARD PODIUM

[76] Inventor: Gerard Scannell, Jr., 6427 First Palm Point, St. Pete Beach, Fla. 33706

[21] Appl. No.: 08/887,272

[22] Filed: Jul. 2, 1997

Related U.S. Application Data

[60] Provisional application No. 60/021,353, Jul. 8, 1996.

[51] Int. Cl.[6] ..... A47G 29/00

[52] U.S. Cl. ..... 248/371; 108/10; 248/118.1; 248/442.2

[58] Field of Search ..... 248/125.3, 125.2, 248/125.9, 130, 132, 133, 136, 150, 371, 398, 410, 118.1, 442.2, 441.1, 918; 108/8, 9, 10

[56] References Cited

U.S. PATENT DOCUMENTS

| | | | |
|---|---|---|---|
| D. 306,943 | 4/1990 | Hodge et al. . | |
| 1,753,378 | 4/1930 | Jones | 108/10 |
| 2,150,397 | 3/1939 | Owen | 108/8 |
| 4,365,561 | 12/1982 | Tellier et al. . | |
| 4,567,835 | 2/1986 | Reese et al. | 248/918 X |
| 4,770,380 | 9/1988 | Eason et al. | 248/165 |
| 5,104,073 | 4/1992 | VanBeek et al. | 248/118.3 |
| 5,207,405 | 5/1993 | Cobb | 248/125.3 X |
| 5,413,414 | 5/1995 | Bauer . | |
| 5,470,036 | 11/1995 | Vu et al. | 248/118.5 |

FOREIGN PATENT DOCUMENTS

| | | |
|---|---|---|
| 10491 | 4/1980 | European Pat. Off. . |
| 171770 | 6/1960 | Sweden . |
| 366364 | 2/1963 | Switzerland . |
| 2120315 | 11/1983 | United Kingdom . |
| WO93/21019 | 10/1993 | WIPO . |

*Primary Examiner*—Ramon O. Ramirez
*Attorney, Agent, or Firm*—Richard G. Litman

[57] ABSTRACT

An adjustable keyboard podium including a portable and collapsible table for computer keyboard, mouse pad, and document holder. The podium also includes a telescopic stand with a slotted bracket attached to the bottom surface of the table are means to adjust the vertical height, horizontal position and angle of the work surface to meet criteria of ergonomic considerations.

12 Claims, 3 Drawing Sheets

ADJUSTABLE KEYBOARD PODIUM

CROSS-REFERENCE TO RELATED APPLICATION

This application claims the benefit of U.S. Provisional Patent Application Ser. No. 60/021,353, filed Jul. 8, 1996.

BACKGROUND OF THE INVENTION

1. Field of the Invention

The present invention is directed to an ergonomic computer console podium. More specifically, the present invention pertains to an adjustable keyboard podium having a rollable stand and collapsible table for a computer keyboard, mouse pad, and document holder. In addition, the work surface of the podium features ergonomic wrist pads armrests and is vertically and angularly adjustable for optimum ergonomic considerations.

2. Description of Related Art

The invention is an adjustable keyboard podium as a versatile ergonomic platform for computer keyboard and mouse pad which may be adjusted to any height and several angles, so it may be used by either a sitting or standing operator, and stored under the computer table or desk when not in use.

The following U.S. and foreign patents are relevant to the invention of adjustable keyboard stands. In particular, the U.S. patent numbers and respective inventors are U.S. Design Pat. No. D 306,943, issued Apr. 3, 1990 to Hodge et al.; U.S. Pat. No. 4,365,561, issued Dec. 28,1982 to Tellier et al.; U.S. Pat. No. 4,770,380, issued Sep. 13, 1988 to Eason et al.; U.S. Pat. No. 5,104,073, issued Apr. 14, 1992 to VanBeek et al.; U.S. Pat. No. 5,413,414, issued May 9, 1995 to Bauer; U.S. Pat. No. 5,470,036, issued Nov. 28, 1995 to Vu et al. In addition, relevant foreign patents include 171, 770 of Sweden published Jun. 21, 1960; 366,364 of Switzerland published Feb. 15, 1963; 10,491 of the European Patent Office published Apr. 30, 1980, 2,120,315(A) of Great Britain published Nov. 30, 1983; and 93/21,019 of the World Intellectual Property Organization published Oct. 28, 1993.

The above patent references disclose that keyboard supports have been the subject of earlier patents. Of particular interest is the patent to Eason et al., which discloses a collapsible stand for music keyboards. Furthermore, the patent to VanBeek et al. discloses an arm and hand rest for a keyboard, with means to adjust the vertical height, a platform for the keyboard and ergonomic wrist pads. In addition, the patent to Tellier et al. discloses a support for input devices, such as a keyboard or a mouse with a mouse pad. The support incorporates means to adjust its vertical height and a stand with a flat base. Hodge is a patent on the design of a keyboard stand which mimics the utility patent of Eason. Bauer describes an insert in telescoping cylinders which facilitates the length adjustment. Vu describes an ergonomic wrist and hand support. The above-listed patents were selected to illustrate patents in the field of keyboard supports. The foreign patents are merely cumulative of the U.S. patents. None of the above inventions and patents, taken either singularly or in combination, is seen to describe the instant invention as claimed. Thus an adjustable keyboard podium solving the aforementioned problems is desired.

SUMMARY OF THE INVENTION

Ergonomics is the science of positioning one's body to allow for proper man-machine interaction while reducing the stress on the body while working. Ergonomics has become a major concept in work place safety, injury, and efficiency considerations. The positioning of the body while at the computer keyboard and mouse pad is crucial to avoiding fatigue so as to minimize consequential errors and injury. A major injury is REPETITIVE STRESS INJURY (RSI), which can result from cumulative stress of repetitive hand motions on the computer. Some computer users experience neck and back pain, headaches, wrist discomforts as well as eye strain. Sometimes, a radical change in the users position, like going from a sitting to standing position, can result in relief from the discomforts of RSI. Extensive studies have generated ergonomic considerations of importance, and these may be found in the literature.

These ergonomic considerations indicate that certain human body to machine configurations are optimum. Such considerations can be met by adjusting the positions of the material to be transcribed, the location of the keyboard and mouse and pad on the podium work surface as well as setting the work surface at appropriate height and angle to accommodate the height, arm and wrist of the computer operator. Two of these considerations recommend that the monitor and document to be transcribed should be 18 to 30 inches from the eyes and that the elbow should be horizontal to the center of the keyboard with the wrist straight. Though some of these goals can be achieved with furniture designed for office use, the major concern now is the proliferation of computers in the home, positioned on tables and other home furniture, and used by a variety of people in the family, from children to grandparents. Although ergonomic design may be either a statutory requirement or an economic necessity in the work place, it receives minimal consideration in the home; yet, the consequences of fatigue and RSI are still present.

Primarily for the home, a computer keyboard and mouse pad podium is desired which is fully and easily adjustable in height to accommodate children to tall people, either sitting or standing. It is also important that podium be portable, mobile and storable, say under the work table. To assure personal comfort and other ergonomic considerations, the podium top should have an angular adjustment and a raised periphery as a wrist rest as well as an appendage to comfortably cradle the operator's arm.

The present invention is such an adjustable keyboard podium, which includes a portable and collapsible table for computer keyboard, mouse pad, and document holder. The present podium further includes means to adjust the vertical height, horizontal position and angle of the work surface to meet the criteria of ergonomic considerations. The working surface features ergonomic wrist pads and armrests, and is set to a stand having lockable casters.

Accordingly, it is a principal objective of the invention to achieve ergonomic criteria in a portable versatile and adjustable computer keyboard and mouse pad podium.

It is a further objective of the invention to provide improved elements and arrangements thereof in an adjustable keyboard podium for the purposes described which is inexpensive, dependable and fully effective in accomplishing its intended purposes.

These and other objectives of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention for a versatile computer keyboard podium comprises two major sections. The first section is the podium table, having A) ancillary right and left armrests, B) holding means for keyboard, mouse pad and document, C) wrist rest, and D) podium hinge means. The second section is the podium stand means, with its adjustable height and pedestal.

Figure 1:
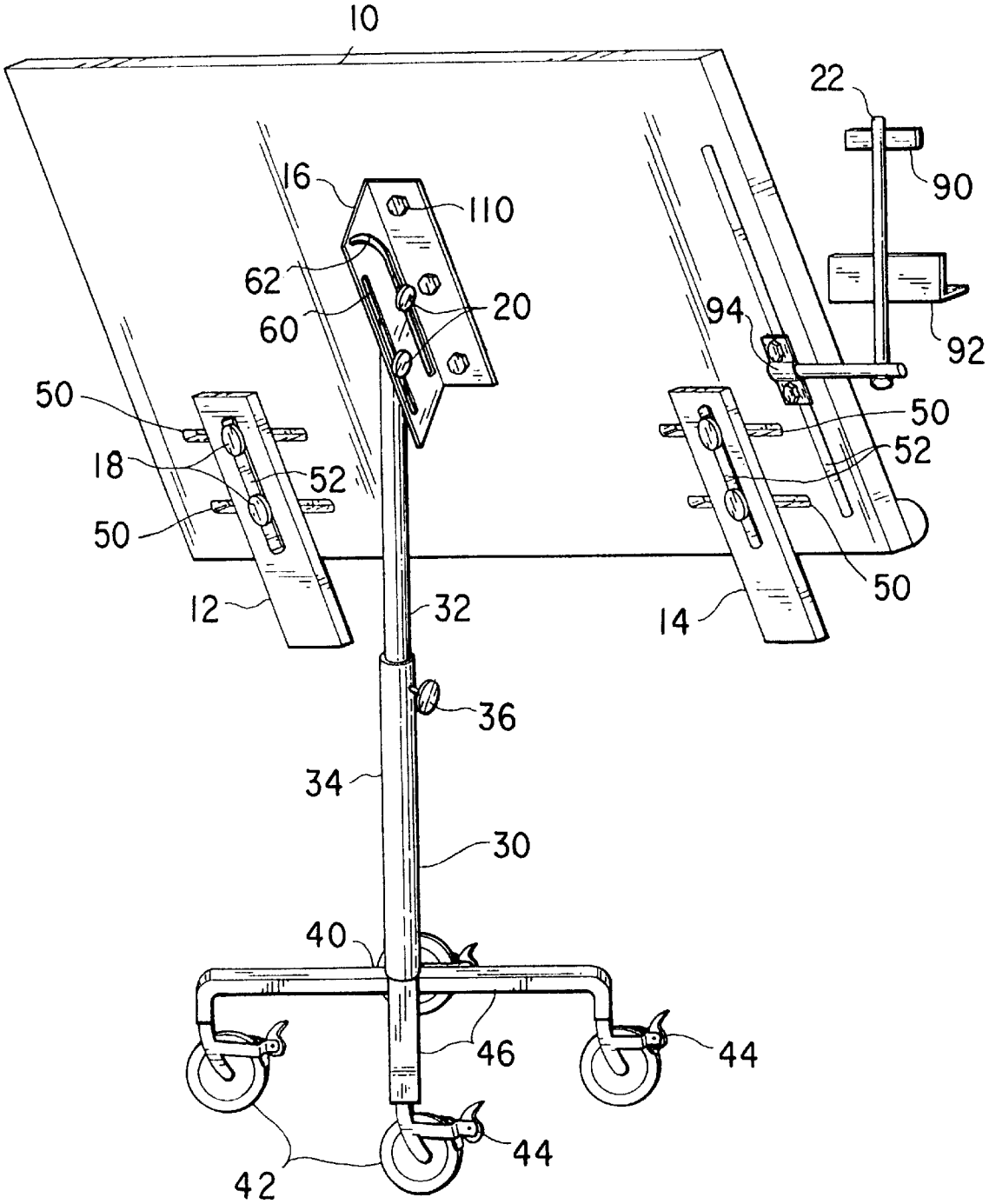
FIG. 1 is an perspective lower surface view of an adjustable keyboard podium according to the present invention.

FIG. 1 is a perspective lower surface view of the podium table 10 for an adjustable keyboard podium showing the detail of the connection of the stand means 30 to the lower surface of the podium table 10 by a podium hinge means 16. On the front of the table protrudes the right armrest 12 and the left armrest 14. To make the position of each of these armrests adjustable,. for back and forth displacement, there is a b/f slot 52 cut through each armrest section that goes under the podium table so that the armrest may be moved back and forth to the desired comfortable length in accord with ergonomic considerations. In a cooperative function, cut from the lower surface of the podium table 10 for right and left placement, there is a blind r/l slot 50 positioned at right angles to the b/f slot 52. Through the intersection of the two slots is a captive fastener 100 engaged in a sliding fit in the r/l slot 50 which may be cinched by a armrest clamp 18 which can be a threaded knob to tighten down on a threaded portion of the captive fastener shaft. A generic captive fastener with a broad head for engaging the r/l slot 50 is of the stove bolt type.

On the left edge of the podium table is the document holder 22. The document holder 22 has an "L" shaped frame with a document clip 90 and document support 92 to grasp and support the document. The document holder 22 is held to the podium table 10 by a document holder clamp 94 which may be a "UU" strap held to the table through a pair of captive fasteners 100 in an elongated blind b/f slot 52 in the lower surface of the podium table 10. The document holder clamp 94 is secured with nuts or threaded knobs. The document holder 22 may be positioned at any comfortable distance in accord with ergonomic considerations along the side of the table by cinching down on the holder clamp 94 at a selected spot in the elongated slot 52 in the lower surface of the podium table 10. The document holder clamp 94 is adjustabilty attached to the horizontal frame segment of the document holder 22 is a friction fit, permitting the holder to be pivoted to assure a comfortable viewing angle. If the upper longer segment of the "L" shaped document holder 22 is of square bar stock with a threaded cylindrical end to penetrate the shorter lower segment of the document holder, and assembled to the lower segment with a nut, the upper segment of square bar stock may be rotated transversely to the lower segment to assure a comfortable sweep angle for viewing.

The podium table 10 is preferably provided without the armrests 12 and 14, and document holder 22. These features are optionally added by the user for his further comfort and convenience. In addition, the user has the ability to add or remove the armrests 12 and 14, and document holder 22 at his discretion.

Also illustrated in FIG. 1 is the podium hinge means 16 which is attached to the podium table 10 and adjusts the position and angle of the podium table 10 by cinching of the podium clamp 20. One such podium hinge means is an angle bracket with a pair of slots through it. It is attached to the lower surface of the podium table 10 by fixed place fasteners 110. The lower hinge slot 60 is straight and the upper slot is a hooked slot 62. This hooked slot 62 has a arc segment and a contingent straight segment. The straight segment is collaterally parallel to the lower hinge slot 60. The arc segment describes an approximate 90° circumferential sector about an end of the lower slot. Captive fasteners not shown from the stand means 30 go through respective slots and are cinched down by the podium clamp 20 which may be threaded knobs. The slope, i.e., the difference in diameter of the fasteners and the width of the slot, determines the horizontal angle the podium table may be set at any position. The length of the slot pairs determining the back and forward position attitude of the podium table relative to the stand means 30. The angle of the arc in the hooked slot 62 is to permit the podium table 10 to be folded against the stand means 30 for storage.

Figure 3:
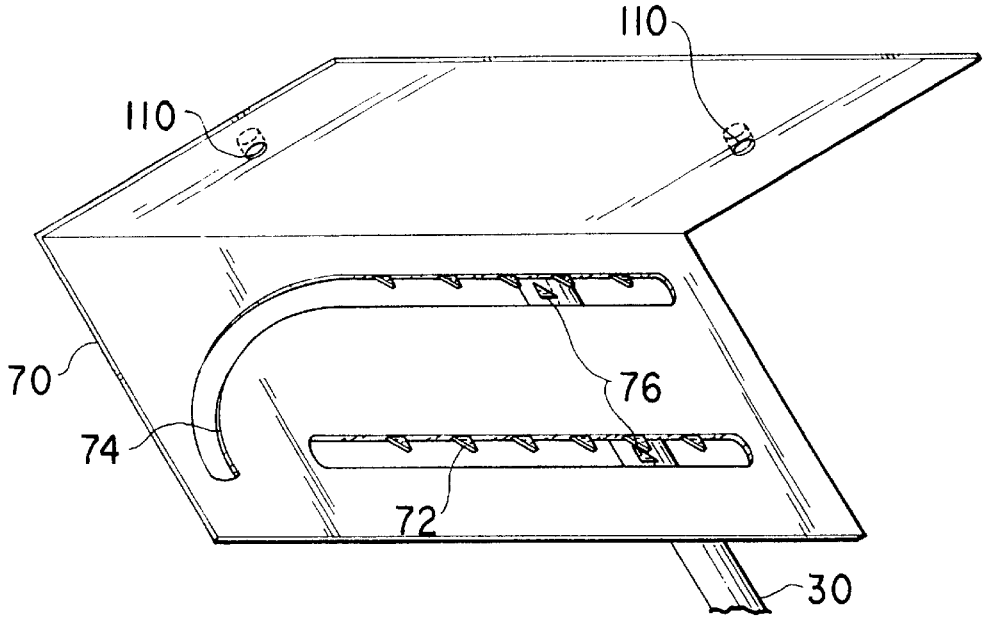
FIG. 3 is a perspective side view of a ratchet podium hinge according to the present invention.

A podium hinge means which would be more rigid is illustrated in FIG. 3 as a perspective side view of a ratchet podium hinge 70. It is also attached to the lower surface of the podium table 10 by fixed place fasteners 110. The additional rigidity of the set angle of the podium table 10 to the stand means 30 is obtained by the rachet action in a ratchet podium hinge 70. The ratchet action is obtained through serrations, or saw-like teeth, cut into the top half of the slot. The lower toothed slot 72 is straight and the upper slot is a hooked toothed slot 74 with teeth along its straight sector. Again, the straight sector of the hooked tooth slot 74 is parallel and collateral with the lower toothed slot 72. The captive fastener used in this configuration has a machined segment cog shaft 76 which penetrates from the stand means 30 through respective slots engaging the valley between the teeth and cinched down by the podium clamp 20, which may be a threaded knob. Here the position and angular attitudes of the table in respect to the stand is set in increments determined by the fineness of the teeth. However, the courser the teeth, the more secure the ratchet. The arc sector of the hooked toothed slot 74 remains smooth.

Figure 4:
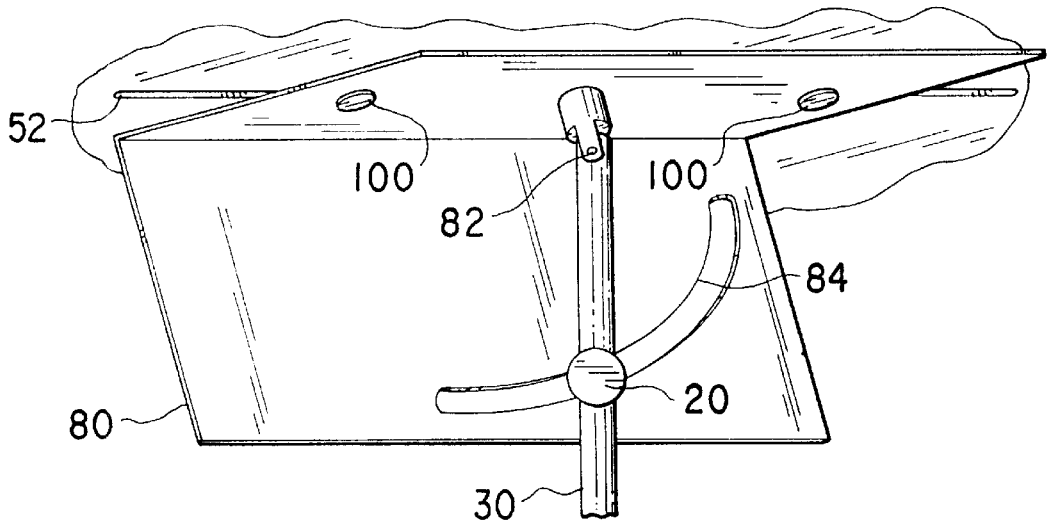
FIG. 4 is a perspective side view of a swing arc podium hinge according to the present invention.

Another podium hinge means is shown in FIG. 4 is a swing arc podium hinge 80. This is also an angle bracket but it is joined to the podium table 10 along another blind b/f slot 52 which holds captive fasteners 100 and cinched by also using a podium clamp 20, similar to armrest clamp 18. The position attitude of the stand means 30 in respect to the podium table 10 is set by locating the swing arc podium hinge 80 along the b/f slot 52 and cinching down on the captive fasteners 100. The angular attitude of the podium table 10 is adjusted by rotation about the stand/table pivot 82 and locked by cinching down the podium clamp 20 on a captive fastener 100 from the stand means 30 through the arc slot 84. The arc slot describes a circumferential arc about the stand/table pivot 82 of about 105°, so the podium table may be set at any angle. The mechanical configuration of the swing arc podium hinge 80 assures greater position security because of the restricted degrees of freedom associated with a fixed pivot versus dual slots.

The podium hinges, as described with respect to FIGS. 1, 3, and 4, set forth an extensive angle range with which to position the podium table 10. In the preferred arrangement, the podium table is horizontally set for a sitting person. Whereas, a forward sloping angle of 17° is preferred for a standing person. The standing person would have the 17° angle of the podium table 10 downwardly inclined so as to allow his arms and hands to address the keyboard and mouse in a natural, comfortable, and convenient position.

The stand means 30 may be adjusted in height through the height adjusting means such as the sliding engagement of cooperating telescoping cylindrical tubes. This is also illustrated in FIG. 1. The top part of the inner tube 32 engages the podium hinge means 16 with one or more captive fasteners secured by a podium clamp 20. The lower end of the inner tube 32 slides into the mating outer tube 34. The height of the podium table may be set by varisus height adjustment means.

One such height adjustment means may be a hydraulic system (not shown) joined to the inner and outer tubes. Hydraulic actuators are commercially available as a complete system of a cylinder and piston with associated compatible hydraulic pump and reservoir for a variety of lift specifications. Preferably, for example, the height adjustment means is an actuator for a gas spring type pneumatic cylinder, located internally of outer tube 34. The gas spring type pneumatic cylinder is conventionally available in various extension lengths. In the preferred embodiment, a five or eight inch extension has a greater useability for the keyboard podium.

Figure 2:
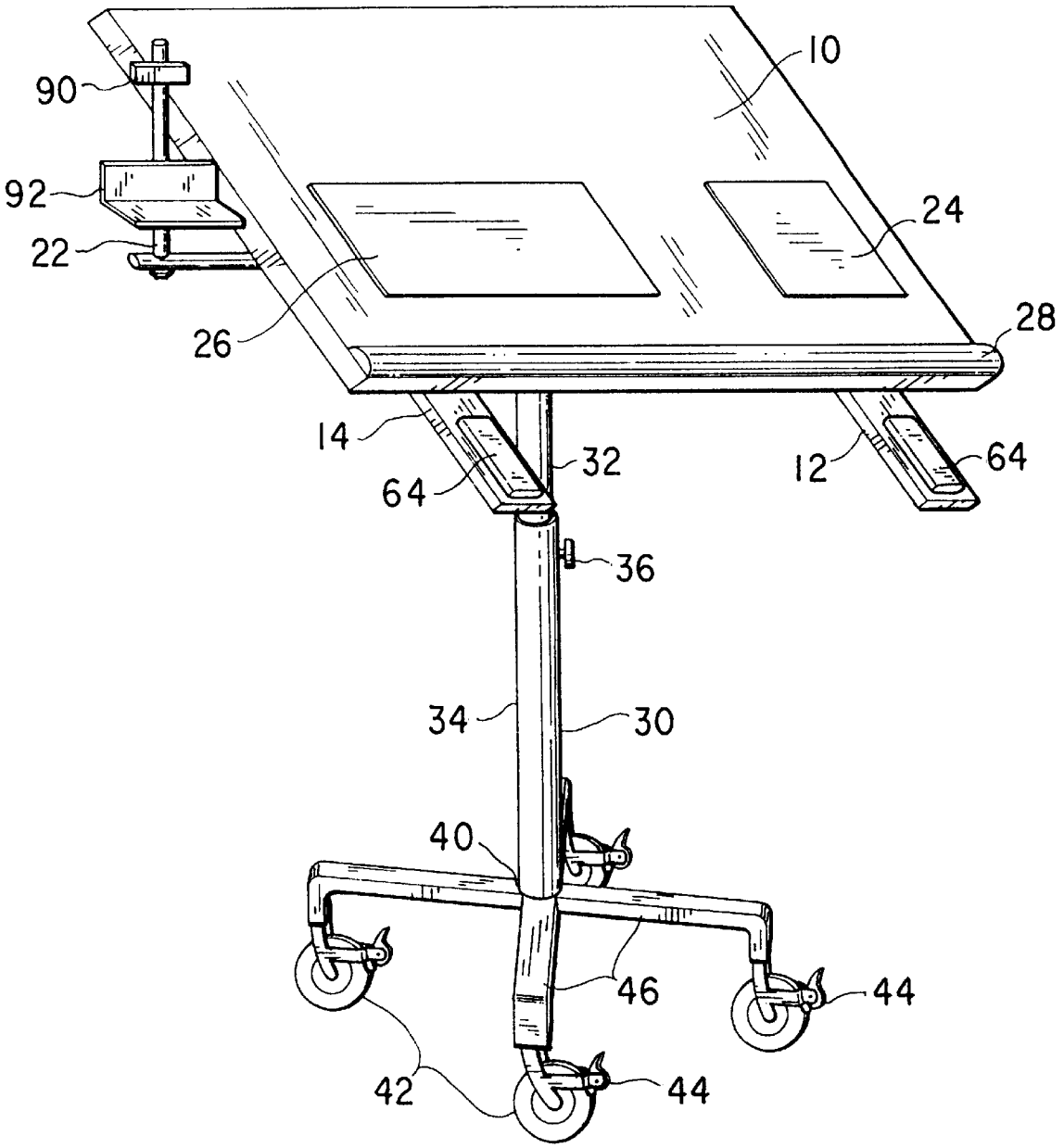
FIG. 2 is a perspective upper surface view of a adjustable, keyboard podium according to the present invention.

Another height adjusting means (not shown) can be made with a male threaded locking collar turning on the outer tube 34 which rides on a jack screw set into the inner tube 32, permitting the height to be set by a screwing action of a threaded collar on the jack screw. Illustrated in FIGS. 1 and 2 is a telescoping outer tube 34 having a stand clamp 36 which can cinch down on the inner tube 32. For additional security there can be indents in the sliding inner tube 32 to assure a positive locking in increments. The clamp may then be a threaded shaft set into a hand knob. The bottom of the outer tube 34 is joined to the base 40. The base has three or more legs 46 to assure stability. Although four legs 46 are shown, it is a conventional preference to include five such legs. At the extremities of the legs 46 are casters 42 and caster locks 44. The use of casters 42 make the table mobile and the caster locks 44 assure position permanence.

The upper surface of the podium table 10 is shown in FIG. 2. New items shown in this Figure include the mouse pad holder means 24, the keyboard holder means 26 and the wrist rest 28. In addition, armrest padding 64 is apparent. The wrist rest 28 and armrest padding 64 is shaped and padded with resilient material, say foam of appropriate elasticity, to assure comfortable intimate contact with the arm and wrist of the computer operator. The means to position and secure the mouse pad and keyboard may be mechanical stops, fasteners, or hook and loop fabric fasteners. Also, the podium upper surface, in cooperation with the wrist pads, may include a recess for holding and positioning the keyboard and mouse pad, further facilitating the security of such.

Achieved in the above invention is versatility in adjustments of podium height, angular attitude, and position attitude. In addition personal comfort is assured by permitting optimum placement of the documents to be transcribed, armrests, keyboard and mouse pad. The podium table may be folded to the podium stand for out of the way storage under a table or against a wall.

It is to be understood that the present invention is not limited to the embodiments described above, but encompasses any and all embodiments within the scope of the following claims.

I claim:

1. An adjustable keyboard podium for providing an ergonomic work surface for the hands, wrists, arms, eyes, back and neck to a computer operator, said adjustable keyboard podium supporting a keyboard, a mouse and a mouse pad, and a document for transcription, said keyboard podium comprising:

a podium table with an upper surface and a lower surface said upper surface having at least one edge of predetermined length;

a computer keyboard retaining means disposed on said upper surface for retaining the keyboard;

a computer mouse pad retaining means for retaining the mouse pad, said mouse pad retaining means being disposed on said podium table upper surface adjacent to said computer keyboard retaining means;

podium hinge means attached to said lower surface of said podium table for angularly adjusting said podium table, said podium hinge means comprising:

a bracket having at least an intermediate bend and a distal edge;

a plurality of fasteners for securing said bracket to said lower surface of said podium table;

said bracket having a straight lower first hinge slot parallel with said distal edge, and an upper second hinge slot disposed between said lower hinge slot and said intermediate bend;

said upper second hinge slot having an arc segment and a contingent straight segment wherein straight segment being parallel to said lower first hinge slot and said arc segment extending through a 90° circumferential arc about an extremity of said lower first hinge slot;

a first captive fastener coupled to said stand means and extending through said lower first hinge slot;

a second captive fastener coupled to said stand means and extending through said upper second hinge slot; and podium clamp means for grasping and manually cinching said first and second captive fasteners to said bracket;

wherein said arc segment of said upper second hinge slot permits said podium table to be folded flat against said stand means; and computer stand means coupled to said podium hinge means for vertically adjusting the height of said podium table;

whereby said podium hinge means and stand means cooperate so that said podium table may be set at any height, angle, and position relative to said stand means within a range of height, angle and position of ergonomic consideration.

2. The adjustable keyboard podium according to claim 1, further including a raised strip of resilient material along said at least one edge of said upper surface for supporting the wrists of the compute operator.

3. The adjustable keyboard podium according to claim 1, said arc segment of said upper second hinge slot permits said podium table to be positioned in a work range between 0° horizontal and 20° off horizontal.

4. The adjustable keyboard podium according to claim 1, said straight lower hinge slot and said straight segment of said upper second hinge slot each having a plurality of teeth projecting therein, and said arc segment being smooth.

5. The adjustable keyboard podium as defined in claim 1 wherein said stand means has a height adjustment means comprising;

an inner tube connected to said podium hinge means;

an outer tube variably and telescopically receiving said inner tube therein;

a stand lamp for locking said inner and outer tubes at a preselected variably set height; and a base of at least three legs connected to said outer tube, each of said at least three legs having a lockable caster at an end thereof;

wherein said podium table being telescopically clamped to a preselected height of ergonomic consideration, and said lockable casters preventing involuntary movement of said stand means.

6. The adjustable keyboard podium according to claim 1, further comprising at least one armrest extending from said lower surface below said at least one edge.

7. The adjustable keyboard podium according to claim 6, further including means for adjusting each of said at least one armrest with respect to said podium table for cradling and supporting the arms of the computer operator.

8. The adjustable keyboard podium according to claim 6, wherein each of said at least on armrest having a resilient padding member thereon.

9. The adjustable keyboard podium according to claim 1, further comprising document holder means removably secured to said podium table for holding the document for transcription and setting the held document at varying positions and angular attitudes.

10. The adjustable keyboard podium according to claim 1, further comprising adjusting armrest means, said adjusting armrest means including:

a plurality of r/l slots blindly grooved into said lower surface of said podium table;

a plurality of captive fasteners with heads in sliding engagement in said r/l slots;

a b/f slot cut through each of said right and left armrest which is penetrated by shaft of said captive fasteners; and an armrest clamp engaging said plurality of captive fasteners, said armrest clamp cinching said plurality of captive fasteners to said podium table;

wherein said adjusting armrest means being selectively set at a position by a transverse motion of said captive fasteners in said slots and said adjusting armrest means being secured by engaging said clamp upon said fasteners and cinching down on said adjusting armrest means.

11. An adjustable keyboard podium for providing an ergonomic work surface for the hands, wrists, arms, eyes, back and neck to a computer operator, said adjustable keyboard podium supporting a keyboard, a mouse and a mouse pad, and a document for transcription, said keyboard podium comprising:

a podium table with an upper surface and a lower surface said upper surface having at least one edge of prodetermined length;

a computer keyboard retaining means disposed on said upper surface for retaining the keyboard;

a computer mouse pad retaining means for retaining the mouse pad, said mouse pad retaining means being disposed on said podium table upper surface adjacent to said computer keyboard retaining means;

podium hinge means attached to said lower surface of said podium table for angularly adjusting said podium table; and computer stand means coupled to said podium hinge means for vertically adjusting the height of said podium table;

wherein said podium hinge means is a swing arc podium hinge comprising:

a b/f slot blindly grooved into said lower surface of said podium table;

a plurality of first captive fasteners having heads each slidably engaging said b/f slot;

an angle bracket coupled to said lower surface of said podium table by said plurality of captive fasteners;

an armrest clamp for cinching said angle bracket;

a stand pivot attached to said angle bracket and cooperating with said stand means;

an arcuate hinge slot having a 105° circumferential sector arc about said stand pivot;

a second captive fastener coupled to said stand means and penetrating said arcuate hinge slot; and a podium clamp means for grasping and manually cinching said second captive fastener to said stand means;

whereby cinching of said podium clamp means on said second captive fastener penetrating said arcuate hinge slot permitting the angular adjustment of said podium table.

12. The adjustable keyboard podium according to claim 1, said arcuate hinge slot and said stand pivot permitting said podium table to be positioned in a work range between 0° horizontal and 20° off horizontal.

* * * * *